US006417765B1

(12) United States Patent
Capanna

(10) Patent No.: US 6,417,765 B1
(45) Date of Patent: Jul. 9, 2002

(54) RAILWAYS MEANS ANTI-COLLISION AND ANTI-DERAILMENT SAFETY SYSTEM

(76) Inventor: Franco Capanna, Via Quarto Peperino, 30-00188, Rome (IT)

( * ) Notice: Subject to any disclaimer, the term of this patent is extended or adjusted under 35 U.S.C. 154(b) by 0 days.

(21) Appl. No.: 09/530,928

(22) PCT Filed: Nov. 12, 1998

(86) PCT No.: PCT/IT98/00320

§ 371 (c)(1),
(2), (4) Date: May 8, 2000

(87) PCT Pub. No.: WO99/25598

PCT Pub. Date: May 27, 1999

(30) Foreign Application Priority Data

Nov. 14, 1997 (IT) ..... RM97A0706

(51) Int. Cl.[7] ..... B60Q 1/00

(52) U.S. Cl. ..... 340/435; 340/425.5; 246/166; 246/170

(58) Field of Search ..... 340/435, 425.5, 340/703, 938; 246/121, 126, 166, 166.1, 167 R, 170

(56) References Cited

U.S. PATENT DOCUMENTS

| | | | | |
|---|---|---|---|---|
| 4,578,665 A | | 3/1986 | Yang | 246/166.1 |
| 5,346,163 A | * | 9/1994 | Momma et al. | 246/5 |
| 5,429,329 A | | 7/1995 | Wallace et al. | 246/166 |
| 5,623,244 A | * | 4/1997 | Cooper | 340/425.5 |
| 5,627,508 A | * | 5/1997 | Cooper | 340/425.5 |
| 5,978,718 A | * | 11/1999 | Kull | 701/9 |
| 5,986,547 A | * | 11/1999 | Korver et al. | 340/500 |
| 6,218,961 B1 | * | 4/2001 | Gross et al. | 340/903 |

FOREIGN PATENT DOCUMENTS

| | | |
|---|---|---|
| DE | 26 31 654 | 12/1977 |
| EP | 0 117 763 | 9/1984 |
| FR | 2 586 391 | 2/1987 |

* cited by examiner

*Primary Examiner*—Daniel J. Wu
*Assistant Examiner*—Davetta W. Goins
(74) *Attorney, Agent, or Firm*—Young & Thompson

(57) ABSTRACT

A railway anti-collision and anti-derailment safety system, comprises a self-propelled trolley adapted to precede a train. The trolley has sensor structure to reveal anomalies or obstacles along railroad tracks, and an integration system between the trolley and a train to pilot the trolley from the train and to transfer from the trolley to the train information as to anomalies or obstacles. The trolley responds to the detection of anomalies or obstacles to eject the trolley forcibly from the tracks to one side of the tracks.

9 Claims, 2 Drawing Sheets

RAILWAYS MEANS ANTI-COLLISION AND ANTI-DERAILMENT SAFETY SYSTEM

FIELD OF THE INVENTION

The present invention relates to railways means anti-collision and anti-derailment safety system.

BACKGROUND OF THE INVENTION

As it is well known, the problem of railways safety is one of the most relevant, also in view of the recent accidents occurred, even involving deaths.

SUMMARY OF THE INVENTION

The object of the present invention is that of providing a system able to increase safety of railway circulation, based on the check in real time of the conditions of the structure along which the railways vehicle is moving and of its accessibility without risks by the same vehicle.

Another object of the present invention is that of improving the present safety systems, integrating the same.

The solution according to the present invention is divided into two categories, namely the use in the specific field of the railways safety and a potential further extended application for the advantage of the traffic capability along the lines.

a) diagnostic instrument checking the condition of the infrastructures and warning means for potential danger to be used along the railways route for routes/times dedicated and alternated with respect to those of the trains, or in case of particular emergency, such as attack threats, geophysical upset (earthquakes, hurricanes, etc.).

b) preventing accident in real time along lines employing advanced signalling and control systems; along long distance lines not watched.

c) Increase of the train density under safety conditions.

Common element to reach the above objects is a pilot trolley, remote controlled and able to prevent, thanks to its running along the railways lay-out with an anticipated time/space (useful) with respect to the means to be protected, any accident of the means due to obstacles, deformation of the lay-out and of the air line, bad working of the switches and of the signalling system, terrorist attacks, high speed, driver illness, etc.

In the first case, the trolley will precede and defend the safety of a wagon-locomotive suitably equipped to make in real time any diagnosis of the railway network and of the signalling and control systems, included the measurement of the progressive condition of the wearing condition, on said wagon operating technicians specialised in diagnosis. In this case the role of the trolley will be that of preventing accidents and damaging of the testing-wagon and its passengers, as well as that of being the test means for a subsequent use for the direct protection of the same trains, provided in the second case. The pilot trolley is in any case provided with diagnosis instruments.

In the same case, the trolley will be used as direct protection of the train, univocally dedicated to the same train and controlled by the same.

The above is valid both for the technical feasibility and for the following development, testing and use step.

At the same time, many of the outcome of said development and testing in exercise will be a common base for the optional passage to the second category.

The solution proposed according to the present invention is applied in a particularly convenient way to fast railway means along dedicated routes, as well as to traditional low speed means along medium—long routes and unattended or scarcely attended routes.

With respect to the safety systems presently known, it represents a remarkable improving, being able to satisfy the limitation of the known systems.

In fact, systems presently employed limit their intervention to standard operative conditions, that can be referred to an established (and thus theoretical) model of the operativeness of the infrastructures and railway systems.

The solution suggested according to the present invention, beside constituting a supplemental safety automatized system, also intervenes in real time on any variable with respect to the standard conditions that could induce accidents, such as derailments and collisions, said variable being for example sudden obstacles along the route, track deformations, switch malfunctioning, system black-out, attacks, geophysical events, etc. that cannot be revealed by the other systems.

Furthermore, the solution suggested according to the present invention can be integrated by new technologies presently under study and application (e.g. computerised, satellitar systems, electronic cartography, etc).

Main features of the solution suggested according to the present invention therefore comprise:

- possibility of intervention in case of risks not revealable by other systems, such as:
  - train coming in the opposite direction along the same track;
  - obstacle along the tracks (stones, trees, animals, etc.);
  - unexpected unfitness of the infrastructure (collapses, landslips, floodings, ice, etc.);
  - explosion for terrorist attack;
  - excess of speed, not suitably moderated by the fixed signs;
  - failure of the fixed safety systems.
- in any case allowing to the train to anticipate the breaking of slowing down to prevent or minimise the derailment or impact risk
- providing to the machine operators direct visible or coded information in advance with respect to the present situation.

These and other results are obtained, according to the present invention, suggesting a basic technical solution providing a remote controlled, self-propelled trolley, proceeding at a suitable distance before the train (said distance varying between 100 meters and a much bigger distance, depending on the speed and the traffic limitation), being able to anticipate in any point of the railway network any information or event that, lacking the trolley, could be verified only at the passage of the same train in that point.

It is therefore specific object of the present invention a railways means anti-collision and anti-derailment safety system comprising a self-propelled trolley remote controlled from the train locomotive, able to proceed in front of the same train, at a suitable distance, or frontally coupled to the same train, when the train is stopped, or during the crossing of critic switching platforms, and provided with sensor means to reveal anomalies, obstacles, etc. along the railroad; an integration system between the train and the trolley, to pilot the trolley from the train and transfer from the trolley to the train any information revealed; and a trolley self-elimination system, with forced ejection from the railroad.

Preferably, according to the invention, said trolley has a very light profile, made up of very flat material and provided with ballast, in order to simulate the train effect, said ballast being particularly comprised of a removable plastic container, filled with water, lead spheres or any other substance which, once released, does not hamper the coming train.

Still according to the invention, said trolley can be provided of a protected front portion with progressive dampening system.

Still according to the invention, said trolley can have an independent motorization, providing any kind of engine.

Furthermore, according to the invention, the electric traction of the trolley can be realised with a retractable pantograph.

Always according to the invention, said trolley can be realised in such a way to replicate the same critical conditions of derailment of the train, and to be provided of speed control automatically connected with the train or with the wheels.

Still according to the invention, an environmental visual reading system, particularly a telecamera, can be provided on said trolley, as well as fixed or satellitar system electronics, as well as of electronic cartography.

The trolley can be further provided with a suitable side skid simulation system (gyroscope or trigonometric reading of fixed signals provided on the railroad).

Said train—trolley integration system is preferably comprised of a data and images, dedicated and cryptographic, anti-intrusion and input transmission system.

The integration system provides a manual or remote correction intervention system.

Furthermore, according to the invention, mechanisms are provided on said trolley co-operating for the fixing of the trolley to the same train and relevant elevation from the tracks.

BRIEF DESCRIPTION OF DRAWINGS

The present invention will be now described, for illustrative but not limitative purposes, according to its preferred embodiments, with particular reference to the figures of the enclosed drawings, wherein.

DETAILED DESCRIPTION

Figure 1A:
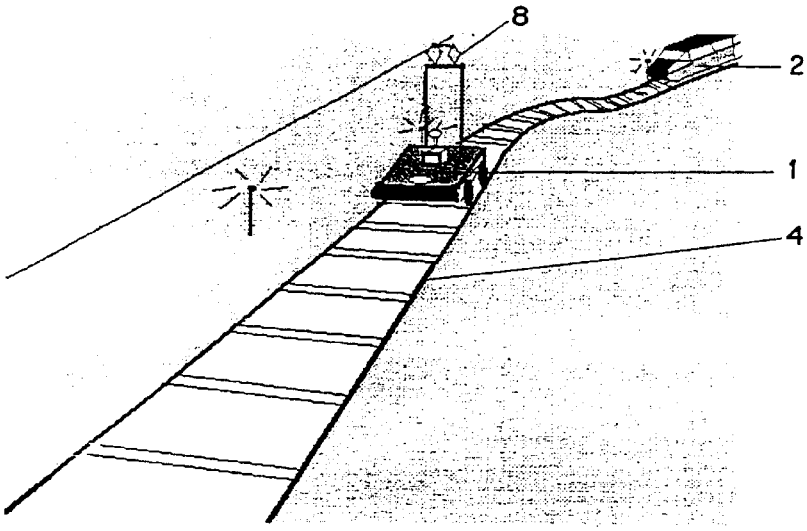
FIGS. 1*a*–1*c* represent a schematic view of an embodiment of the system according to the invention.
Figure 1B:
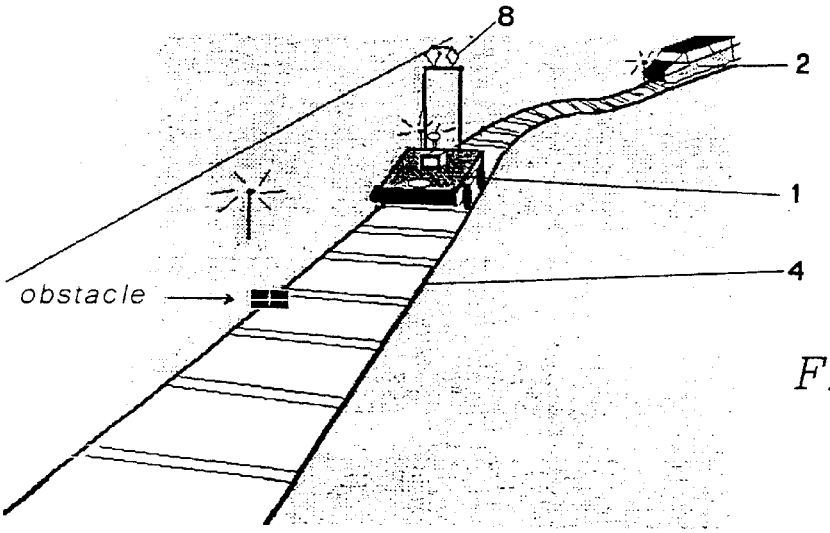
Figure 1C:
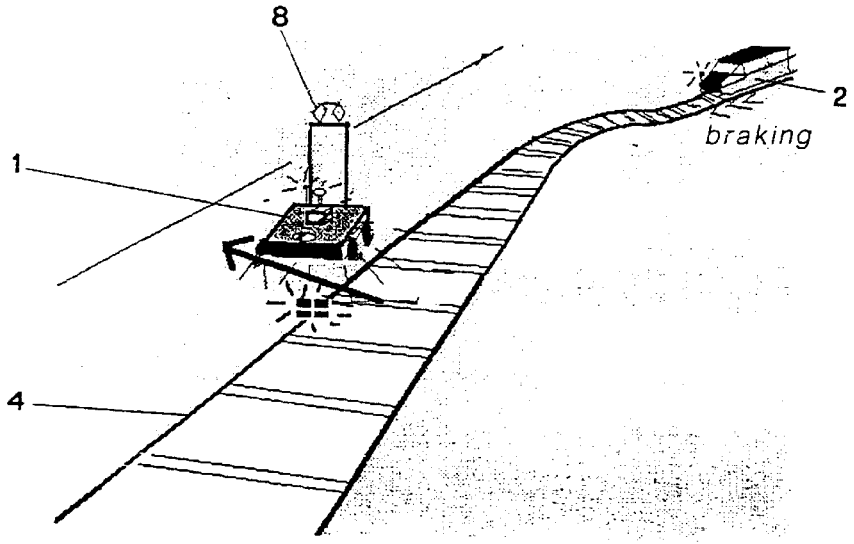
Figure 2:
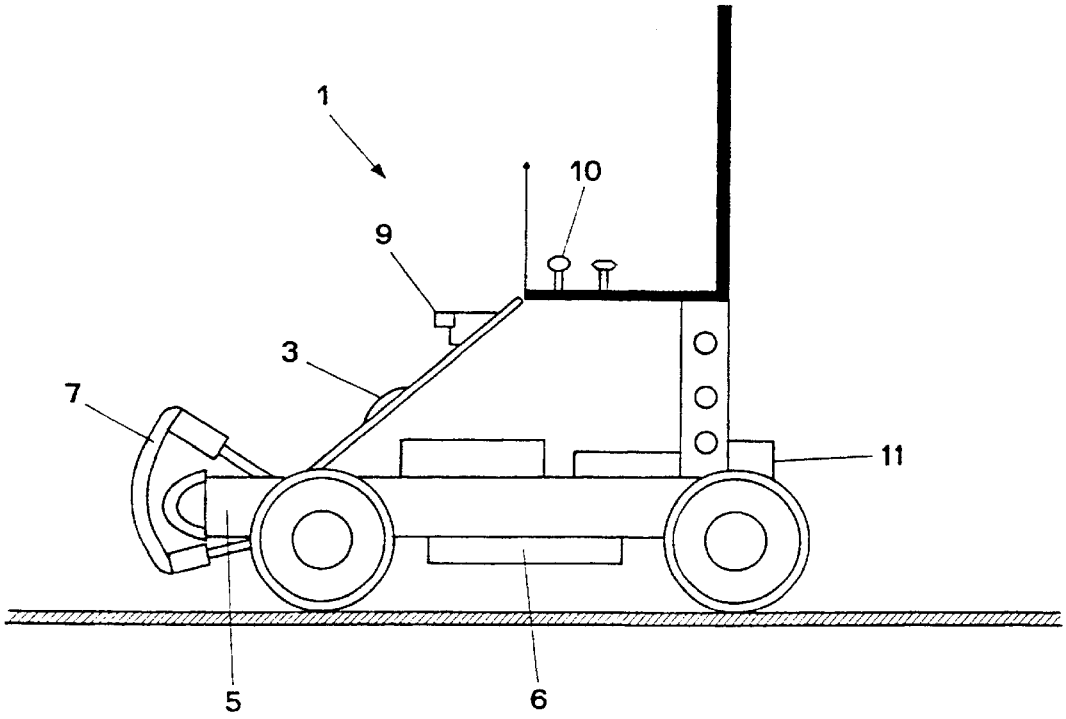
FIG. 2 is a lateral view of the trolley of the system of FIG. 1.

The system according to the invention, a preferred embodiment of which is shown in the enclosed figures, comprises a self-propelled light trolley 1, remote controlled from the locomotive, and running before the same train at a suitable distance and the same instantaneous speed.

It is further provided a train 2—trolley 1 integration system (not shown), suitable to pilot the trolley 1 from the train 2 and to automatically transfer from the trolley to the train any information or emergency impulse—action caused by events that could potentially induce risks (collision or derailment), revealed by the trolley sensors 3 or occurred to the same trolley during its running (e.g. an obstacle along the tracks 4).

Trolley 1 further provides a trolley self-elimination system 5, with forced ejection from the railroad, aiming to prevent accidental events caused by the same trolley 1.

Trolley 1 of the system according to the invention has an extra-flat and aerodynamic profile, and is made by ultra-light material, suitably ballasted by a removable plastic container 6, filled with water and lead spheres.

Front portion of the trolley 1 is protected by a progressive effect dampening system 5 to reduce active damages.

Its electrical traction is obtained by a retractile pantograph 8.

Trolley 1 is designed in such a way to replicate the same critical conditions of derailment of the train and it is provided with a speed control automatically connected with the train 2.

Furthermore, on the trolley an environment visible reading system 9 (e.g. a telecamera) and fixed or satellitar signalling system electronics are provided, including electronic cartography reading, where applicable, and side skid indicators.

Sensors 3 can reveal any physical event connected to risk factors (impact, beginning of the derailment, explosion, etc.) and are connected to the relevant automatism for the transmission to the train 2.

Behind the trolley 1 a hooking mechanism 10 is provided, said mechanism operating for example at the entrance within the station. Consequently, In a slowing down—braking or stopping condition, trolley 1 is recovered by the same locomotive of the train 2, which reintegrate the same into its profile by the hooking mechanism 10, and the corresponding mechanism provided on the front portion of the locomotive, eventually lifting the trolley 1 from the tracks 4 and/or realising the ballast 5, if necessary.

Data an image transmission system form the trolley 1 to the train 2 and vice versa will be dedicated and cryptographic in such a way to have anti-intrusion-immission features.

Trolley 1 is automatically piloted by the train 2 control system, with the possibility of corrective (e.g. distance) or manual (e.g. trolley "elimination" control) intervention.

Trolley 1 continuously transmits video and data information to the control room of the locomotive 2; said information are sent to the automatic systems of train 1 to allow the start of the safety procedures already provided on the same train 2.

In case of impact or side skid-derailment of the trolley 1, a suitable emergency signal will automatically operate the breaking system of the train 2.

In case of failure to the trolley, or loose of contact between the trolley 1 and the train 2, that could prefigure the risk of train 2—trolley 1 impact or between the trolley 1 and other means, automatic/manual self-elimination system 5 will laterally eject the trolley out of the railroad.

Self-elimination will occur toward the side not covered by the other track, with a thrust caused by suitable instantaneous thrusting means (e.g. earth tracking bar or dynamic spring, mini jets, or explosive charge provided in a out of centre position).

Before the self-elimination, trolley 1 will automatically release the ballast 6, breaking the plastic housing and freeing the water and lead spheres content, or other suitable material.

Self-elimination will be also automatically activated due to impacts and side skid—derailment of the trolley.

From the above specification, it is noted that the anti-collision and anti-derailment system according to the present invention, thanks to the running of the trolley 1 at a proper and suitable distance before the train 2 (distance variable according to the speed and the traffic limits), allows to anticipate in any point of the railway network any information or event that, otherwise, could be verified only with the passage of the train 2 in the same point.

The anticipated transmission of said information to the train 2, beside being a "redundance" factor of the already existing safety information, allow to the train 2 to stop or reduce its speed and further covers and prevents, as already said, risk factors that, lacking the trolley 1, would have a direct impact on the same train 2.

In this last case, occurring an event on the trolley 1 (e.g. impact or beginning of the derailment), and automatic system will actuate the braking system of the train 2, while the trolley 1 will be ejected by the mechanism 5.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A railway anti-collision and anti-derailment safety system, comprising a self-propelled trolley adapted to precede a train, the trolley having sensor structure to reveal anomalies or obstacles along railroad tracks, an integration system between the trolley and a train to pilot the trolley from the train and to transfer from the trolley to the train information as to anomalies or obstacles, and structure on the trolley responsive to the detection of anomalies or obstacles to eject the trolley forcibly from the tracks to one side of the tracks.

2. A system as claimed in claim 1, wherein said trolley has a flat profile and is made of light material.

3. A system as claimed in claim 1, wherein said trolley carries ballast.

4. A system as claimed in claim 3, wherein said ballast is a substance which, once released, does not hamper a following train.

5. A system as claimed in claim 3, wherein said ballast is discharged prior to ejection of the trolley from the tracks.

6. A system as claimed in claim 1, wherein said trolley has a protected front portion with a progressive dampening system.

7. A system as claimed in claim 1, wherein said trolley is electrically propelled and has a retractable pantograph to supply electric power to the trolley.

8. A system as claimed in claim 1, wherein said trolley brakes or stops a following train upon detection of an anomaly or obstacle.

9. A system as claimed in claim 1, wherein said trolley carries an environmental visual reading system.

* * * * *